US007487969B2

(12) United States Patent
Christianson

(10) Patent No.: US 7,487,969 B2
(45) Date of Patent: Feb. 10, 2009

(54) KITE SYSTEM HAVING A LIGHT TRANSMITTER AND A LIGHT RECEIVER

(75) Inventor: James Christianson, Colchester, CT (US)

(73) Assignee: Jakks Pacific, Inc., Malibu, CA (US)

( * ) Notice: Subject to any disclaimer, the term of this patent is extended or adjusted under 35 U.S.C. 154(b) by 573 days.

(21) Appl. No.: 11/315,664

(22) Filed: Dec. 20, 2005

(65) Prior Publication Data

US 2007/0152103 A1 Jul. 5, 2007

Related U.S. Application Data

(60) Provisional application No. 60/730,082, filed on Oct. 24, 2005.

(51) Int. Cl.
*A63B 67/14* (2006.01)

(52) U.S. Cl. ..... 273/108; 244/154

(58) Field of Classification Search ..... None
See application file for complete search history.

(56) References Cited

U.S. PATENT DOCUMENTS

| | | | |
|---|---|---|---|
| 286,718 | A | 10/1883 | Linton |
| 368,525 | A | 8/1887 | Fleharty |
| 391,507 | A | 10/1888 | Burgess et al. |
| 434,725 | A | 8/1890 | Rockwell |
| 1,278,358 | A | 9/1918 | Lake |
| 1,912,925 | A | 6/1933 | Wallace |
| 1,929,005 | A | 10/1933 | Rolkerr |
| 2,059,634 | A | 11/1936 | Fisher, Jr. |
| 2,134,282 | A | 10/1938 | Irvin |
| 2,208,786 | A | 7/1940 | Astle |
| 2,484,316 | A | 10/1949 | Simons |
| 2,804,276 | A | 8/1957 | Hutson |
| 2,811,327 | A | 10/1957 | Roe |
| RE24,542 | E | 9/1958 | Hutson |
| 3,006,109 | A | 10/1961 | Boese |
| RE25,734 | E | 2/1965 | Boese |
| 3,357,660 | A | 12/1967 | Condrashoff |
| 3,430,899 | A | 3/1969 | Zopf |
| 4,042,195 | A | 8/1977 | Howard |
| 4,133,500 | A | 1/1979 | Chapman |
| 4,177,991 | A | 12/1979 | Mayer et al. |
| 4,810,224 | A | 3/1989 | Devincent |
| 4,842,222 | A | 6/1989 | Baird |
| 4,865,575 | A | 9/1989 | Rosenthal |
| 4,911,383 | A | 3/1990 | Elson |

(Continued)

*Primary Examiner*—John M Hotaling, II
*Assistant Examiner*—Tramar Harper
(74) *Attorney, Agent, or Firm*—Tope-McKay & Associates

(57) ABSTRACT

A kite system having a light transmitter and a light receiver is described. The kite system comprises a kite having a light receiver attached with the kite. The light receiver is capable of receiving and registering a light signal. A light transmitter is included for emitting a light signal. The light transmitter is encased within a hand held transmitter housing. The hand held transmitter further includes a kite string attachment mechanism for holding kite string for attaching with the kite. A user may fly the kite and use the light transmitter to project the light signal toward the light receiver, and upon receiving the light signal, the light receiver registers that it has received the light signal. Additionally, the kite system is formed as a kite shooting game such that hitting the light receiver with the light signal provides a user with a point.

27 Claims, 4 Drawing Sheets

U.S. PATENT DOCUMENTS 4,942,506 A * 7/1990 Flory ..... 362/253
5,741,185 A 4/1998 Kwan et al.
6,163,507 A * 12/2000 Gholson ..... 368/12
6,435,456 B1 8/2002 Clawson
6,443,397 B1 9/2002 Morris
6,503,119 B1 1/2003 Lapointe
6,663,050 B2 12/2003 Tabor
2001/0030263 A1 10/2001 Ciochetti
2002/0106966 A1 * 8/2002 Jimenez et al. ..... 446/454
2004/0195459 A1 10/2004 Pouchkarev

* cited by examiner

KITE SYSTEM HAVING A LIGHT TRANSMITTER AND A LIGHT RECEIVER

PRIORITY CLAIM

The present application is a non-provisional patent application, claiming the benefit of priority of U.S. Provisional Application No. 60/730,082, filed on Oct. 24, 2005, entitled, "Kite and Release Mechanism."

BACKGROUND OF THE INVENTION (1) Field of Invention

The present invention relates to a toy kite, and more particularly to a toy kite system having a light transmitter for transmitting a light signal and a light receiver for receiving and registering the light signal.

(2) Description of Related Art

Toy kites have long been known in the art. Typically, kites consist of some sort of air catch or wing device that is flown in the air while tethered to a string. Recently, some innovative accessories have been added to traditional kites, such as releasable parachutes.

In other art, interactive toy shooter games have long been a fascination with children and adults alike. With recent technological advances, some shooter games have become equipped with light transmitters and light receiver devices. The light transmitter and receiver devices allow a user to shoot another user with a light beam, while the shot user's receiver registers the shot.

However, nothing heretofore conceived has allowed a user to shoot a kite with a light beam and register the shot. Thus, a continuing need exists for a toy kite system that allows a shooter to shoot a kite and register the shot.

SUMMARY OF INVENTION

The present invention relates to a kite system having a light transmitter and a light receiver. The kite system comprises a kite for flying. The kite includes a light receiver attached with the kite that is capable of receiving and registering a light signal. The kite system also comprises a light transmitter for emitting a light signal. A user may fly the kite and use the light transmitter to project the light signal toward the light receiver, and upon receiving the light signal, the light receiver registers that it has received the light signal.

In another aspect, the light transmitter is a transmitter selected from a group consisting of an infra red transmitter and a laser transmitter.

In another aspect, the light transmitter is encased within a hand held transmitter housing to form a hand held transmitter.

In yet another aspect, the hand held transmitter further includes a kite string attachment mechanism for holding kite string for attaching with the kite.

Additionally, the kite system is formed as a kite shooting game such that hitting the light receiver with the light signal provides a user with a point.

In another aspect, the kite further comprises a plurality of light receivers.

In yet another aspect, each of the plurality of light receivers is configured to register a different point value upon receiving the light signal.

Additionally, the light receiver is further configured to provide a hit signal to the hand held transmitter when it registers a light signal, and wherein the hand held transmitter is further configured to receive a hit signal and upon receiving the hit signal and to provide a hit signal alarm to indicate that the light receiver has registered a light signal.

In another aspect, the light receiver further comprises a hit signal transmitter for transmitting the hit signal to the hand held transmitter, and wherein the hand held transmitter further comprises a hit signal receiver for receiving the hit signal and providing the hit signal alarm.

In another aspect, the hit signal alarm is an alarm mechanism selected from a group consisting of an audible alarm, a light alarm, and a vibratory alarm.

The present invention further comprises a second kite having a second light receiver and a second hit signal transmitter; and a second handheld transmitter for transmitting a second light signal. The second handheld transmitter includes a second hit signal receiver. Each handheld transmitter has a first hit signal alarm and second hit signal alarm, where the first hit signal alarm reflects hits on one kite while the second hit signal alarm reflects hits on the other kite. Each of the hit signal transmitters transmits a distinct hit signal and each of the hit signal receivers are capable of distinguishing the distinct hit signals, thereby allowing each handheld transmitter to activate an appropriate hit signal alarm.

Furthermore, each light transmitter is configured to emit a distinct light signal. Each light receiver is configured to only receive and register the other light transmitter's light signal.

Finally, as can be appreciated by one in the art, the present invention also comprises a method for forming and using the kite system described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

The present invention relates to a toy kite, and more particularly to a toy kite system having a light transmitter for transmitting a light signal and a light receiver for receiving and registering the light signal. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

Figure 1:
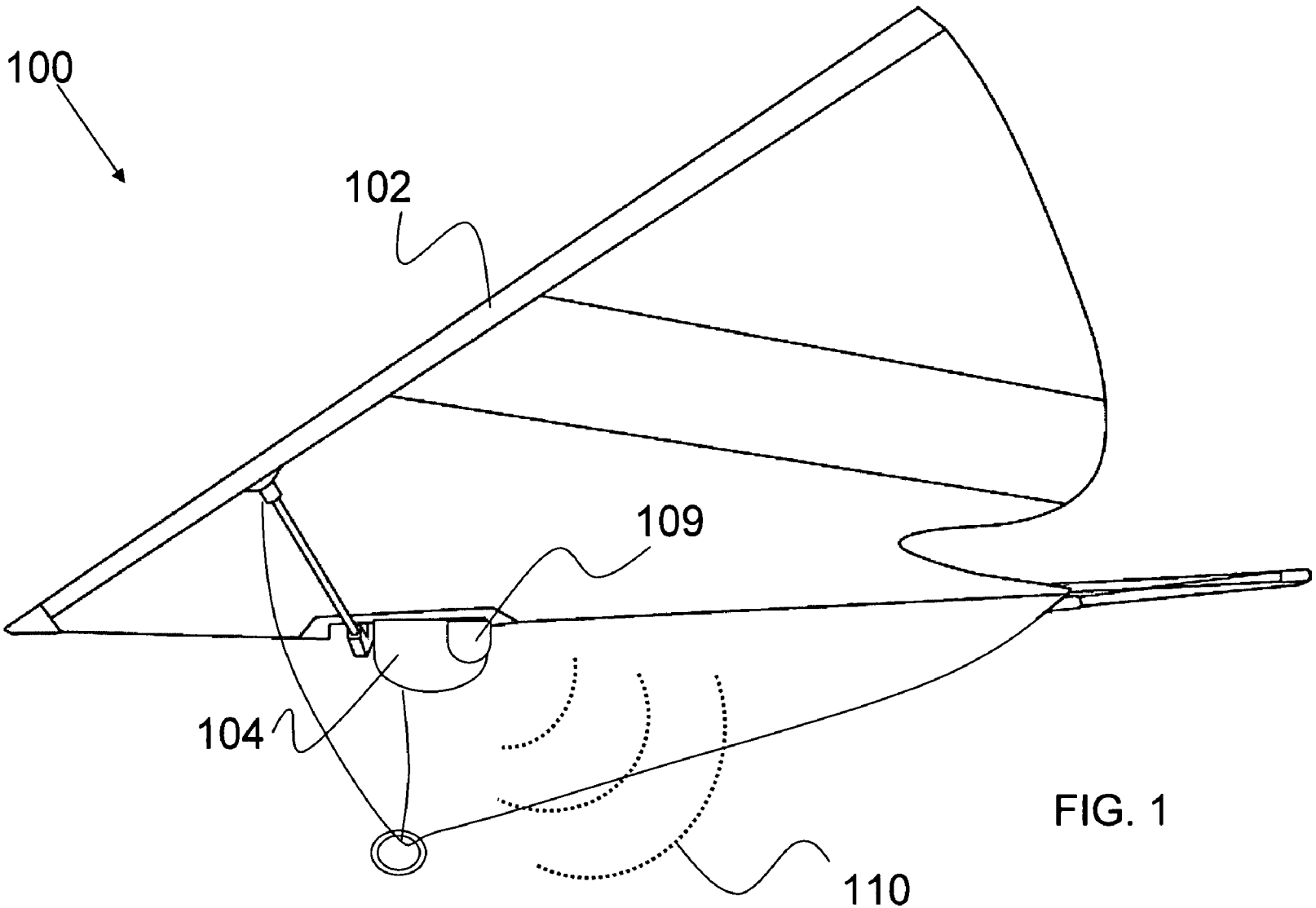
FIG. 1 is a side-view illustration of a kite having a light receiver according to the present invention.

The present invention relates to a kite system that allows a user to shoot a kite with a light beam and register the shot if the kite is hit. As shown in FIG. 1, the kite system 100 includes a kite 102 having a light receiver 104 attached with the kite 102. The light receiver 104 is any suitable mechanism or device capable of receiving and registering (detecting) a light signal, non-limiting examples of which include an infrared receiver and a laser receiver.

Figure 2:
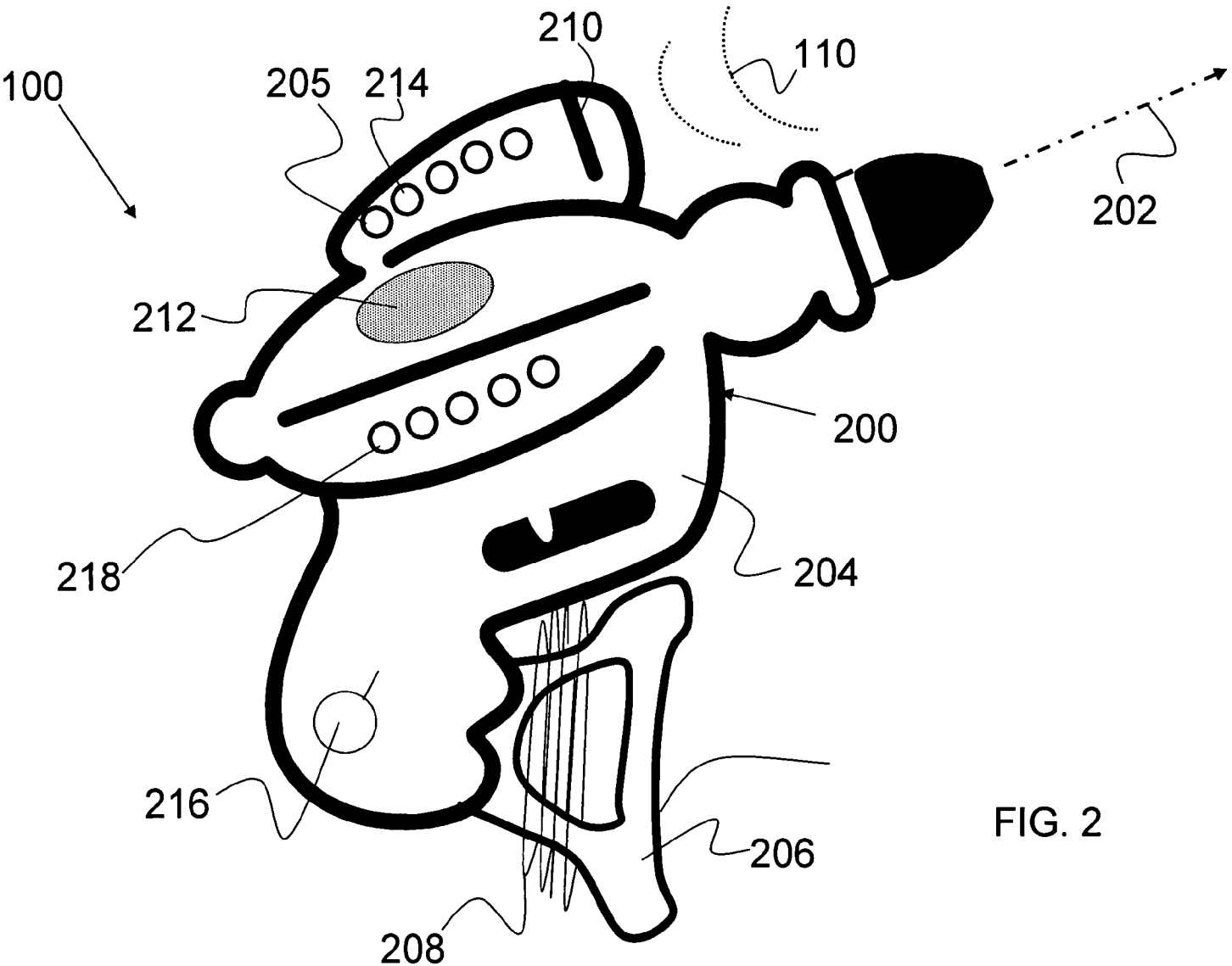
FIG. 2 is a side-view illustration of a light transmitter according to the present invention.

As shown in FIG. 2, the kite system 100 further comprises a light transmitter 200 for emitting a light signal 202. The light transmitter 200 is any transmitter suitable for transmitting a light that is detectable by the light receiver 104, non-limiting examples of which include an infra red transmitter and a laser transmitter. Using the light transmitter 200 and the light receiver 104, a user can fly the kite 102 and use the light transmitter 200 to project the light signal 202 toward the light receiver 104. Upon receiving the light signal 202, the light receiver 104 registers a hit (i.e., that it has received the light signal 202).

The light transmitter 200 is encased within a hand held transmitter housing to form a handheld transmitter 204. When flying the kite 102, a user typically uses a kite string handle for holding the kite string. As applied to the present invention, the kite string handle can be a separate item, or integrally connected with the hand held transmitter 204 as a single unit. When integrally connected, the handheld transmitter 204 further includes a kite string attachment mechanism 206 for holding kite string 208.

In operation, it is desirable to know when the light receiver 104 has been hit with a light signal 202. As such, the light receiver 104 further includes a hit signal transmitter 109 to provide a hit signal 110 to the handheld transmitter 204 when it registers the light signal 202. The hit signal 110 is any suitable wireless signal, a non-limiting example of which includes a radio signal. The handheld transmitter 204 is further configured to receive the hit signal 110 and provide a first hit signal alarm 205 to indicate that the light receiver 104 has registered the light signal 202. To receive the hit signal 110, the handheld transmitter includes any suitable hit signal receiver 210, a non-limiting example of which includes a radio receiver. In another aspect, a wire can be included in the kite string to transmit the hit signal through a wired connection. In yet another aspect, the first hit signal alarm 205 is attached with the kite 102 itself.

The first hit signal alarm 205 is any alarm mechanism that notifies a user that the light receiver 104 registered a hit, non-limiting examples of which include an audible alarm, a light alarm, and a vibratory alarm.

The audible alarm is produced by any sound emitting mechanism, a non-limiting example of which includes a speaker 212. The light alarm is any suitable light emitting mechanism, a non-limiting example of which includes a liquid emitting diode (LED) light 214. Additionally, the vibratory alarm is any suitable mechanism for creating a vibration in the handheld transmitter 204, a non-limiting example of which includes a spinning weight 216.

Figure 3:
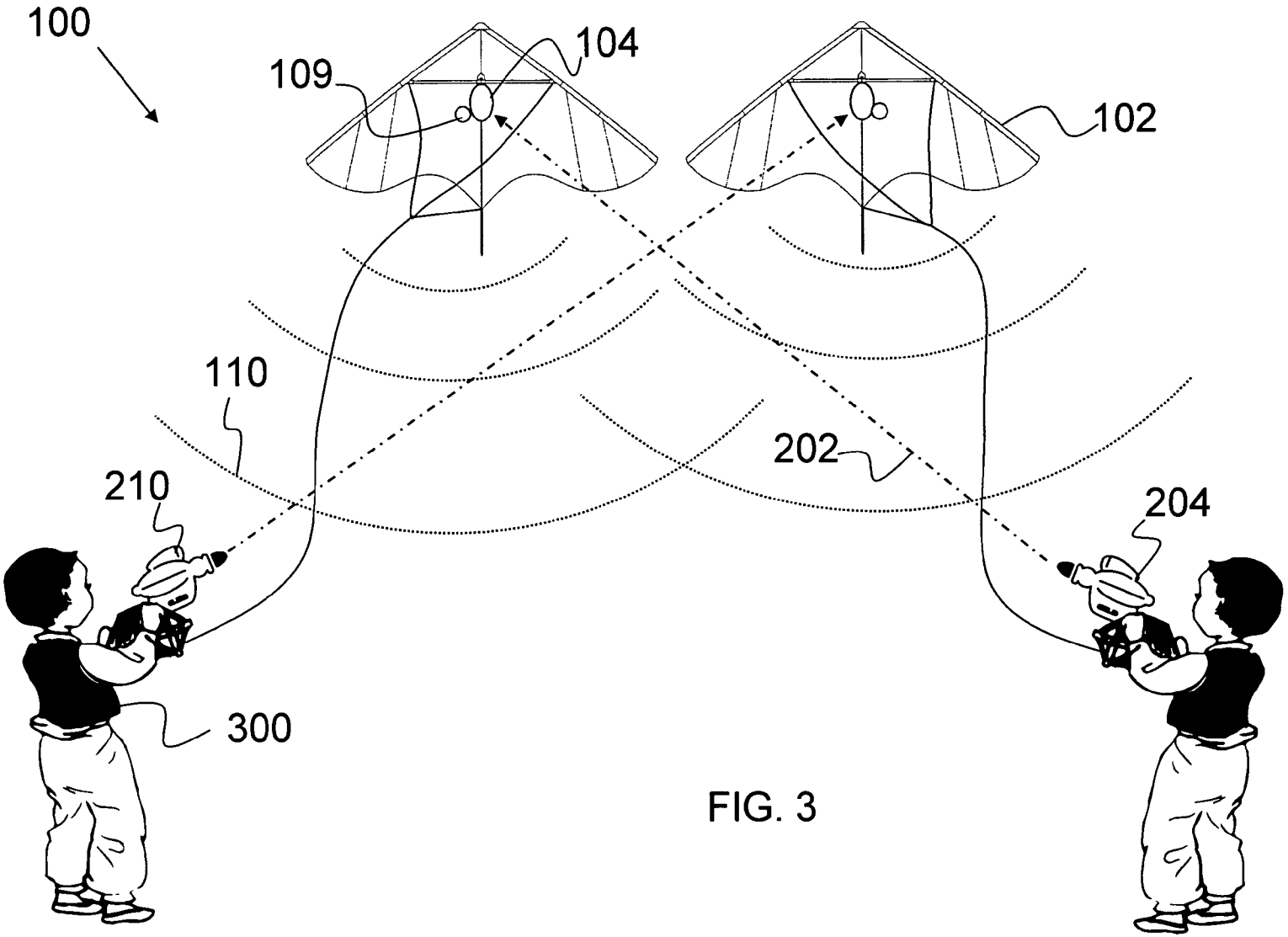
FIG. 3 is an exemplary illustration of multiple kite systems in operation according to the present invention.

The kite system 100 is formed as a kite shooting game. As can be appreciated by one skilled in the art, there are numerous kite shooting games that can be envisioned using the kite system 100 described herein. For example, hitting the light receiver 104 with the light signal 202 provides a user with a point. To further enhance gaming, the kite system 100 can include multiple kites 102 and handheld transmitters 204. In this aspect, and as shown in FIG. 3, at least two users 300 can play the kite shooting game by flying their own kite 102 while attempting to shoot the light receiver 104 attached with another user's kite 102.

While shooting the opponent's kite 102, it may be desirable to know how many times the other kite 102 has registered a hit. In this aspect, the handheld transmitter 204 also includes a second hit signal alarm 218 (shown in FIG. 2) that notifies the user 300 when the opponent's kite 102 has been hit with the light signal 202. The first hit signal alarm 205 (shown in FIG. 2) notifies a user when his/her own kite 102 has been hit, while the second hit signal alarm 218 notifies the user when the opponent's kite 102 has been hit. If lights are used as the hit signal alarm, multiple lights can be used that register a score. As a non-limiting example, multiple (e.g., five) LED's can be included in each of the first hit signal alarm 205 and the second hit signal alarm 218. As the lights illuminate, a user can tell how many times each of their respective kites 102 have registered a hit. The first user to receive the requisite hits loses that particular game. As stated above, there are numerous games that can be created using this device and as such, the example used herein is not intended to be limiting, but is merely provided for illustrative purposes.

To distinguish between an opponent's hit signal 110 and one's own hit signal 110, each hit signal transmitter 109 transmits a unique hit signal 110. Additionally, the hit signal receiver 210 is capable of receiving both hit signals 110 and distinguishing between the two to identify from which kite 102 the hit signal 110 originated.

In another aspect, each of the light signals 202 can be distinct light signals so that a user does not shoot his own kite 102 while attempting to shoot his opponents kite 102. In this aspect, the light receivers 104 are configured to only receive and register the proper light signal 202.

Figure 4:
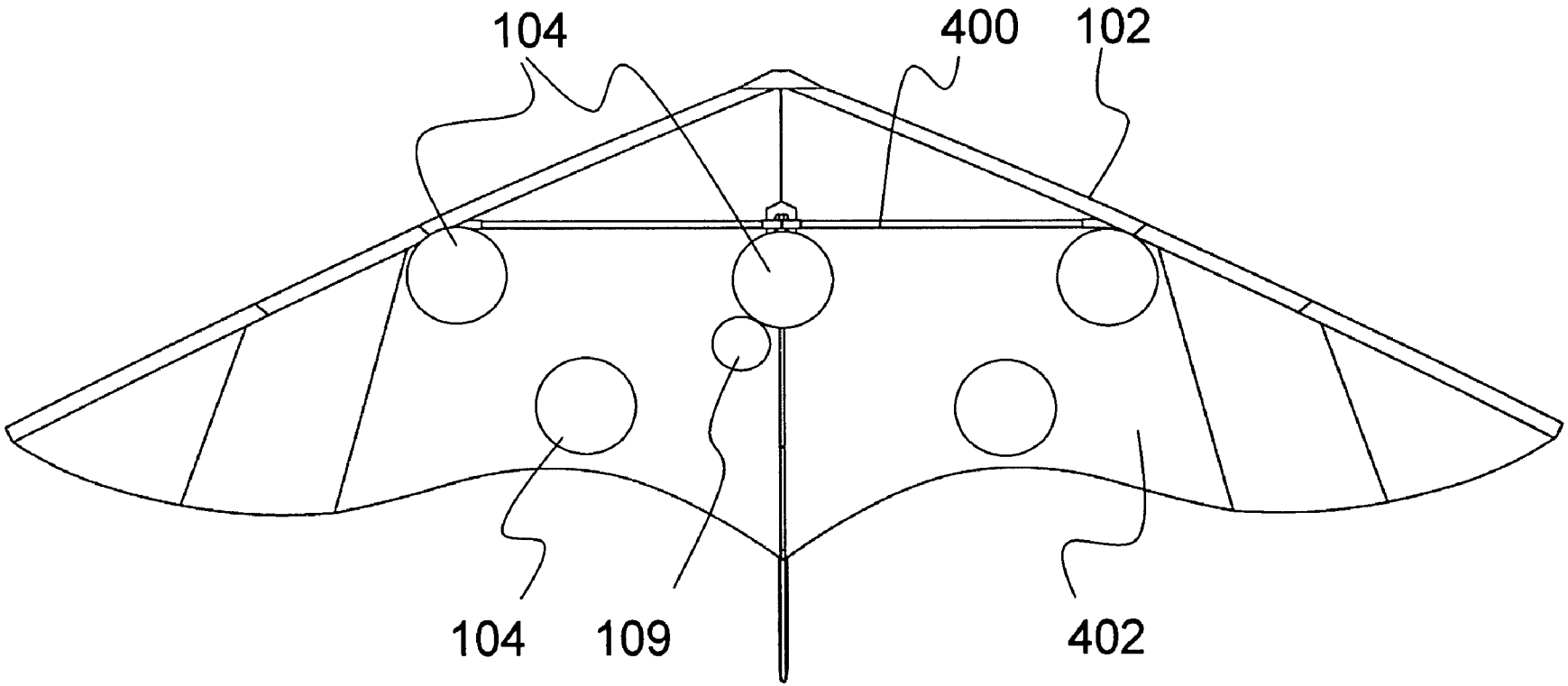
FIG. 4 is a bottom view of a kite having a plurality of light receivers according to the present invention.

FIG. 4 illustrates another aspect of the present invention. As shown in FIG. 4, a plurality of light receivers 104 can be attached with the kite 102. The light receivers 104 can be attached at any suitable stable location on the kite 102. As non-limiting examples, the light receiver 104 is attached with a frame portion 400 or a wing portion 402. Or in another aspect, the light receiver 104 can be attached with the kite string (not shown).

In a gaming aspect, the plurality of light receivers 104 can be configured to register a different point value upon receiving the light signal. For example, a smaller light receiver 104 may register multiple points. As another example, a light receiver 104 in a less accessible location can register multiple points, while the most accessible light receiver 104 registers a single point.

As can be appreciated by one skilled in the art, the kite system of the present invention can be used alone by a single user or used in a kite shooting game having multiple users. When used alone by a single user, a single kite with a single light receiver and a single light transmitter can be used. In this aspect, the light receiver registers hits by the single user. When used with other kites as a kite shooting game, a plurality of users can play using a plurality of kite systems. In this aspect, a user's own kite is configured to only register hits from other users and not the user handling the kite. This can be accomplished through a variety techniques as can be appreciated by one skilled in the art. As a non-limiting example, each light transmitter can be configured to transmit a distinct light signal. A switch on the light transmitter can be used to indicate which signals to exclude (and/or include) as received and registered signals. For example, a user would choose to exclude his own signal from his own kite if playing with other users.

What is claimed is:

1. A kite system having a light transmitter and a light receiver, comprising:

a kite for flying, the kite having a light receiver attached with the kite where the light receiver receives and registers a light signal; and a light transmitter for emitting a light signal, whereby a user may fly the kite and use the light transmitter to project the light signal toward the light receiver, and upon receiving the light signal, the light receiver registers that it has received the light signal; and wherein the kite system is formed as a kite shooting game such that hitting the light receiver with the light signal provides a user with a point.

2. A kite system as set forth in claim 1, wherein the light transmitter is a transmitter selected from a group consisting of an infra red transmitter and a laser transmitter.

3. A kite system as set forth in claim 2, wherein the light transmitter is encased within a hand held transmitter housing to form a hand held transmitter.

4. A kite system as set forth in claim 3, wherein the hand held transmitter further includes a kite string attachment mechanism for holding kite string for attaching with the kite.

5. A kite system as set forth in claim 4, wherein kite system is formed as a kite shooting game such that hitting the light receiver with the light signal provides a user with a point.

6. A kite system as set forth in claim 5, wherein the kite further comprises a plurality of light receivers.

7. A kite system as set forth in claim 6, wherein each of the plurality of light receivers are configured to register a different point value upon receiving the light signal.

8. A kite system as set forth in claim 7, wherein the light receiver is further configured to provide a hit signal to the hand held transmitter when it registers a light signal, and wherein the hand held transmitter is further configured to receive a hit signal and upon receiving the hit signal and to provide a hit signal alarm to indicate that the light receiver has registered a light signal.

9. A kite system as set forth in claim 8, wherein the light receiver further comprises a hit signal transmitter for transmitting the hit signal to the hand held transmitter, and wherein the hand held transmitter further comprises a hit signal receiver for receiving the hit signal and providing the hit signal alarm.

10. A kite system as set forth in claim 9, wherein the hit signal alarm is an alarm mechanism selected from a group consisting of an audible alarm, a light alarm, and a vibratory alarm.

11. A kite system as set forth in claim 10, further comprising:

a second kite having a second light receiver and a second hit signal transmitter;

a second handheld transmitter for transmitting a second light signal, the second handheld transmitter having a second hit signal receiver;

wherein each handheld transmitter has a first hit signal alarm and second hit signal alarm, where the first hit signal alarm reflects hits on one kite while the second hit signal alarm reflects hits on the other kite;

wherein each of the hit signal transmitters transmits a distinct hit signal and wherein each of the hit signal receivers are capable of distinguishing the distinct hit signals, thereby allowing each handheld transmitter to activate an appropriate hit signal alarm.

12. A kite system as set forth in claim 11, wherein each light transmitter is configured to emit a distinct light signal, and wherein each light receiver is configured to only receive and register the other light transmitter's light signal.

13. A kite system as set forth in claim 1, wherein the light transmitter is encased within a hand held transmitter housing to form a hand held transmitter.

14. A kite system as set forth in claim 13, wherein the hand held transmitter further includes a kite string attachment mechanism for holding kite string for attaching with the kite.

15. A kite system as set forth in claim 1, wherein kite system is formed as a kite shooting game such that hitting the light receiver with the light signal provides a user with a point.

16. A kite system as set forth in claim 1, wherein the kite further comprises a plurality of light receivers.

17. A kite system as set forth in claim 16, wherein each of the plurality of light receivers are configured to register a different point value upon receiving the light signal.

18. A kite system as set forth in claim 1, wherein the light receiver is further configured to provide a hit signal to the hand held transmitter when it registers a light signal, and wherein the hand held transmitter is further configured to receive a hit signal and upon receiving the hit signal, to provide a hit signal alarm to indicate that the light receiver has registered a light signal.

19. A kite system as set forth in claim 18, wherein the light receiver further comprises a hit signal transmitter for transmitting the hit signal to the hand held transmitter, and wherein the hand held transmitter further comprises a hit signal receiver for receiving the hit signal and providing the hit signal alarm.

20. A kite system as set forth in claim 18, wherein the hit signal alarm is an alarm mechanism selected from a group consisting of an audible alarm, a light alarm, and a vibratory alarm.

21. A kite system as set forth in claim 18, further comprising:

a second kite having a second light receiver and a second hit signal transmitter;

a second handheld transmitter for transmitting a second light signal, the second handheld transmitter having a second hit signal receiver;

wherein each handheld transmitter has a first hit signal alarm and second hit signal alarm, where the first hit signal alarm reflects hits on one kite while the second hit signal alarm reflects hits on the other kite;

wherein each of the hit signal transmitters transmits a distinct hit signal and wherein each of the hit signal receivers are capable of distinguishing the distinct hit signals, thereby allowing each handheld transmitter to activate an appropriate hit signal alarm.

22. A kite system as set forth in claim 21, wherein each light transmitter is configured to emit a distinct light signal, and wherein each light receiver is configured to only receive and register the other light transmitter's light signal.

23. A kite system for a kite shooting game, comprising:

two kites, each kite having a light receiver attached with the kite, where the light receiver receives and registers a light signal; and two light transmitters, each configured to emit a light signal, whereby at least two users can play the kite shooting game by flying their own kite while attempting to shoot the light receiver attached with another user's kite, such that a user may fly the kite and use the light transmitter to project the light signal toward the light receiver, and upon receiving the light signal, the light receiver registers that it has received the light signal.

24. A kite system as set forth in claim 23, wherein each light receiver is further configured to provide a hit signal to each hand held transmitter when it registers a light signal, and wherein each hand held transmitter is further configured to receive the hit signal and upon receiving the hit signal, to provide a hit signal alarm to indicate that the light receiver has registered a light signal.

25. A kite system as set forth in claim 24, wherein each light receiver further comprises a hit signal transmitter for transmitting the hit signal to the hand held transmitters, and wherein the hand held transmitters further comprise a hit signal receiver for receiving the hit signal and providing the hit signal alarm.

26. A kite system as set forth in claim 25, wherein each of the hit signal transmitters transmits a distinct hit signal and wherein each of the hit signal receivers are capable of distinguishing the distinct hit signals, thereby allowing each handheld transmitter to activate an appropriate hit signal alarm.

27. A kite system having a light transmitter and a light receiver, comprising:

a kite for flying, the kite having a light receiver attached with the kite where the light receiver receives and registers a light signal;

a light transmitter for emitting a light signal, whereby a user may fly the kite and use the light transmitter to project the light signal toward the light receiver, and upon receiving the light signal, the light receiver registers that it has received the light signal;

wherein the light transmitter is a transmitter selected from a group consisting of an infra red transmitter and a laser transmitter;

wherein the light transmitter is encased within a hand held transmitter housing;

wherein the hand held transmitter further includes a kite string attachment mechanism for holding kite string for attaching with the kite;

wherein kite system is formed as a kite shooting game such that hitting the light receiver with the light signal provides a user with a point;

wherein light receiver is further configured to provide a hit signal to the hand held transmitter housing when it registers a light signal, and wherein the hand held transmitter is further configured to receive a hit signal and upon receiving the hit signal, provide a hit signal alarm to indicate that the light receiver has registered a light signal; and wherein the hit signal alarm is an alarm mechanism selected from a group consisting of an audible alarm, a light alarm, and a vibratory alarm.

* * * * *